US006912819B2

(12) United States Patent
Price et al.

(10) Patent No.: US 6,912,819 B2
(45) Date of Patent: Jul. 5, 2005

(54) FASTENING ELEMENT FOR MASONRY UNITS

(75) Inventors: Raymond R. Price, Rochester, MN (US); Christopher E. Price, Rochester, MN (US)

(73) Assignee: Alliance Concrete Concepts Inc., Rochester, MN (US)

( * ) Notice: Subject to any disclaimer, the term of this patent is extended or adjusted under 35 U.S.C. 154(b) by 0 days.

(21) Appl. No.: 10/142,119

(22) Filed: May 8, 2002

(65) Prior Publication Data

US 2003/0208981 A1 Nov. 13, 2003

(51) Int. Cl.[7] ..... E04B 1/38

(52) U.S. Cl. ..... 52/285.3; 52/606; 405/284; 405/286; 405/762

(58) Field of Search ..... 52/606, 285.3, 52/698, 699, 968, 584.1, 604; 405/284, 286, 262; 403/381, 294, 286, 341

(56) References Cited

U.S. PATENT DOCUMENTS 5,307,603 A * 5/1994 Chiodo ..... 52/698
6,540,432 B2 * 4/2003 Albanese ..... 403/388

* cited by examiner

*Primary Examiner*—Carl D. Friedman
*Assistant Examiner*—Steve Varner
(74) *Attorney, Agent, or Firm*—Moore, Hansen & Sumner

(57) ABSTRACT

A fastening element for operatively connecting masonry units together in a fixed relation. The fastening element comprises a body with a web having opposing surfaces, and a plurality of projections that extend in a generally perpendicular direction therefrom. The projections are spaced apart from each other and configured to engage portions of masonry units therebetween in a constrained relation. The fastening element permits two, three, or four masonry units to be operatively connected together in variety of configurations without the use of mortar.

7 Claims, 2 Drawing Sheets

FASTENING ELEMENT FOR MASONRY UNITS

FIELD OF THE INVENTION

This invention relates generally to the construction of masonry structures. More particularly, the present invention relates to a fastening element for attaching two or more standardized masonry units together into a structure such as a wall.

BACKGROUND OF THE INVENTION

Standardized masonry units (eg. cinderblocks) have been used in construction for many years. They are durable, strong, able to resist large compressive forces, and relatively inexpensive. For these and other reasons they are widely used, particularly in building foundations and as load bearing walls. Typically, the masonry units are joined together into a unitary structure using mortar or cement. As one may imagine, such construction techniques are rather labor intensive. That is, a site must be prepared; footings must be planned, framed up, and poured; masonry units must be delivered to a site; and, mortar must be mixed and transported to various locations at the worksite during construction, etc. Moreover, specialized training and skills are required to construct a straight and true structure. Traditionally, this type of construction has been the province of bricklayers and masons. All of this adds to the time and cost needed to assemble a structure; and this tends to offset the low cost of material. An advantage and a drawback to such a construction is that once completed, the structure is more or less permanent. Changes or alterations after-the-fact can be extremely difficult and expensive, and imperfections or mistakes are usually left as is.

There are instances, however, where it might not be possible to obtain or use mortar, or where skilled, trained workers are not available, or even where there is a limited budget. Alternatively, there might be instances where it might not be desirable or advantageous to assemble a permanent structure, or where future changes or reconfigurations are anticipated. For example, a person may wish to construct a skirting wall around an elevated structure such as a mobile home. In such a situation, it is often not necessary or desirable to assemble the structures using mortar or cement. It follows, then, that the need for skilled craftsmen is obviated. Yet, without the use of mortar or cement, such structures are unable to resist any appreciable transverse forces and are susceptible to premature failure and collapse.

There is a need for a way to operatively connect conventionally sized and formed masonry units together in a variety of structures without the use of mortar or cement. There is also a need for a way to operatively connect two or more standardized masonry units together without modifications or alterations thereto. There is also a need for a way in which to easily modify or disassemble structures formed from standardized masonry units without having to destroy the structure. And, there is a need for a way to increase the utilization of standardized masonry units by reducing the amount of time and skill needed for site preparation and assembly.

BRIEF SUMMARY OF THE INVENTION

The present invention is a fastening element for operatively connecting two or more masonry units together in a fixed relation. The fastening element comprises a generally planar web having opposing surfaces, and a plurality of projections that extend in a generally perpendicular direction therefrom. These projections may extend from one or both opposing surfaces of the generally planar web, and they define slots that are configured to receive segments of masonry units. Preferably, the projections are walls. And preferably, the masonry units are conventional cinderblocks. However, it will be appreciated that fastening elements need not be restricted to cinderblocks, and that the fastening element may be configured to operatively connect other masonry units together.

In a preferred embodiment, the fastening element has projections that extend in a generally perpendicular direction from each of the opposing surfaces of the web. In this form, the projections define oppositely opening slots that are in coplanar alignment with each other. These slots are sized to receive segments of a masonry unit, preferably the longitudinal and transverse walls of a conventional masonry unit such as a cinderblock. The slots need not be the same width, nor do they have to be aligned along a common plane. For example, the slots could have different widths and be aligned with each other along a center plane. Or, the slots could have the same width and be offset with respect to each other in a collateral relation. It should be apparent that the fastening element may be installed in a variety of locations relative to a particular masonry unit. And it should also be apparent with this embodiment, that by varying the widths of the slots and the web, it is possible to operatively connect two, three, or four masonry units together in a fixed relation.

In another preferred embodiment, the projections extend from one surface of the web of a fastening element. In this embodiment, the projections form at least two, and preferably three collaterally aligned slots. As with the slots in the above embodiment, these slots are configured to receive segments of masonry units such as the longitudinal and transverse walls of a cinderblock. This embodiment may be used primarily to operatively connect adjacent masonry units together in a horizontal relation, and may be used a bed upon which the first course of masonry units is laid, or used a cap that is installed on the uppermost course of masonry units.

In yet another preferred embodiment, the fastening element comprises a generally planar web having opposing surfaces, and at least three and preferably four projections that extend in a generally perpendicular direction from each opposing surface of the web. As with the abovementioned projections, these projections define slots that are configured to receive segments of masonry units. Thus, for example, three projections extending from one surface of the web will define two slots, while four projections, extending from on surface of the web will define three slots. With the preferred four-projection arrangement, each surface of the web will have three slots. This allows the fastening element to be installed in a variety of locations on a masonry unit, and it also allows two, three, or four masonry units to be operatively connected to each other. For example, a fastening element may be used to construct vertical structure such as a column. Alternatively, the fastening element may be used to join adjacent masonry units together in a horizontal relation, or in both vertical and horizontal relations.

The use of the fastening elements obviates the need for mortar between the masonry units. This mortarless system is advantageous over traditional brick and mortar constructions for obvious reasons. First, fewer materials are required to build a structure. Thus, the cost of transporting the materials to a site is reduced. Second, less strength and stamina are required because the total amount of materials used is reduced. Moreover, since less stamina is required, a person is able to work for longer periods without breaks. Moreover, because of the relative reduction in the total amount of materials used, on the job injuries die to overexertion and/or fatigue are reduced. Third, no special skills are required to assemble a structure. Fourth, a mortarless structure may be constructed by one person. Thus, the need for an additional person to mix and deliver mortar at a site is eliminated—further reducing the cost of construction. Fifth, since there are no time constraints imposed by drying mortar, a person can assemble a structure at their own pace. Sixth, a mortarless structure may be constructed under conditions, which, for a conventional brick and mortar structure, would be extremely difficult or impossible. It will be appreciated that the use of the fastening elements allows masonry structures to be constructed on a wide variety of surfaces, including soils such as sand or gravel, and construction elements such as beams, flooring, sills, thresholds, etc.—it is not necessary to pour a foundation.

The fastening elements also allow a structure to be disassembled and reassembled. This not only gives flexibility during initial construction, but also allows later renovations to be made easily and inexpensively. For instance, it may be desirable to replace a damaged masonry unit in a structure such as a skirting wall. This may be easily accomplished by removing the appropriate fastening elements and replacing the damaged masonry unit with an undamaged masonry unit.

An object of the invention is to reduce the amount of time and skill needed to assemble concrete masonry units into a structure.

Another object of the invention is to simplify installation of concrete masonry units by eliminating the need for mortar.

A feature of the present invention is that it allows masonry units to be connected to each other in different patterns.

Another feature of the invention is that the device may be installed at various of locations on a masonry unit.

An advantage of the present invention is that a structure of masonry units may be assembled and disassembled with equal facility.

Another advantage of the invention is that essentially all of the components from one structure may be reused or recycled in other structures.

Additional objects, advantages and features of the invention will be set forth in part in the description which follows, and in part will become apparent to those skilled in the art upon examination of the following or may be learned by practice of the invention. The objects and advantages of the invention may be realized and attained by means of the instrumentalities and combination particularly pointed out in the appended claims.

DESCRIPTION OF THE PREFERRED EMBODIMENTS

Figure 1:
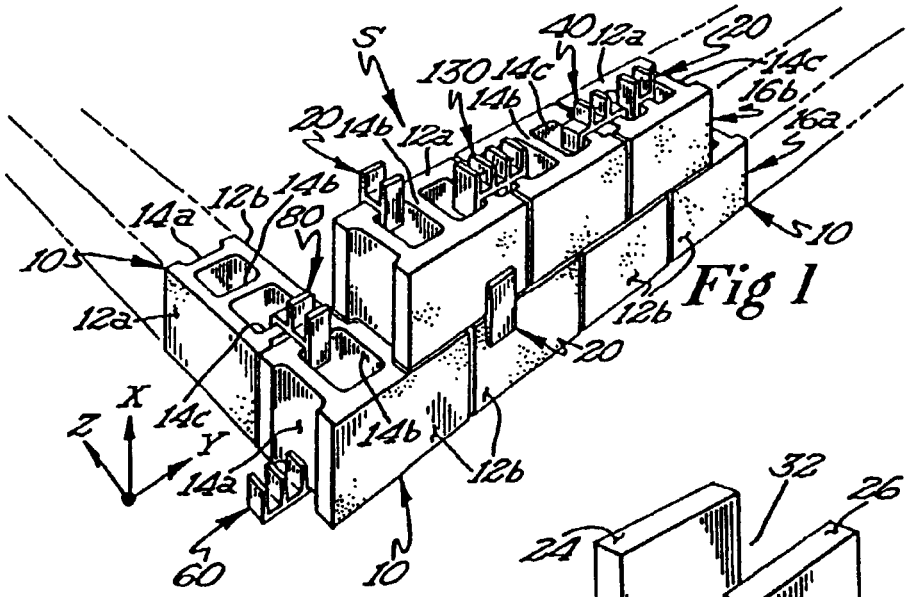
FIG. 1 is a perspective view of preferred embodiments of the invention as they are used to operatively connect masonry units together in a fixed relation.

Referring to FIG. 1, a preferred embodiment depicts a type of structure that may be assembled using the fastening elements of the present invention. Here the structure is a wall structure S comprising a plurality of masonry units 10. As depicted, the masonry units 10 are of the type having a plurality of longitudinal walls 12*a*, 12*b* and plurality of transverse walls 14*a*, 14*b*, 14*c*, such as a cinderblock. It will be appreciated, however, that other types of masonry units may be used. The wall structure S has a first course 16*a* and a second course 16*b*, with the first and second courses arranged in a running bond pattern. Note that the masonry units 10 may be arranged at angles to each other, as with the first course 16*a* of the wall structure "S."

Starting with the upper surface of the second course 16*b*, several preferred fastening elements 20, 40, and 130 are depicted. These fastening elements 20, 40, 130 are operatively connected to masonry units 10 of the second course 16*b* and are ready to engage and operatively connect masonry units 10 of a third course thereto (not shown). The third course of masonry units need not be in the running bond pattern of the first and second courses. That is, the masonry units of the third course may be stacked into columns, if desired. Moving now to the joint between the first 16*a* and second courses 16*b*, several preferred fastening elements 20 and 80 are depicted. And, at the bottom surface of the first course 16*a*, another preferred fastening element 60 is depicted.

Figure 2:
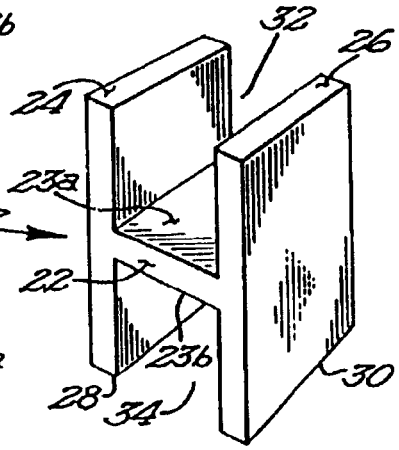
FIG. 2 is a partial, sectional view of some of the preferred embodiments of the invention as they are used to operatively connect masonry units together in a fixed relation.
Figure 4:
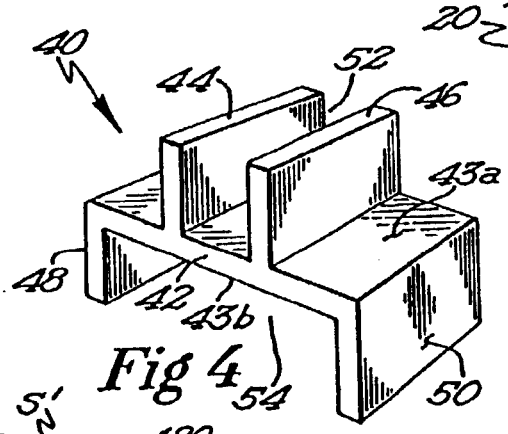
FIG. 4 is a perspective view of another preferred embodiment of the invention.

Referring now to FIG. 2, a preferred embodiment of the fastening element 20 will now be discussed. As shown, the fastening element 20 comprises a generally planar web 22 having opposed surfaces 23*a*, 23*b*. A plurality of projections, 24 and 26, 28 and 30 extend from the opposed surfaces 23*a* and 23*b*, respectively. These projections extend in a generally perpendicular direction to define oppositely opening slots 32 and 34, which are configured and arranged to receive segments of a masonry unit such as a cinderblock. As depicted, the slots 32, 34 are substantially the same width and are In a coplanar alignment with each other. Moreover, they are symmetrically arranged with respect to the web 22. It will be appreciated that by fabricating a fastening element having slot widths roughly the same width of the transverse and/or longitudinal walls of a masonry unit, it is possible to operatively connect two masonry units together. It will also be appreciated that by fabricating a fastening element having slot widths that are greater than one or more transverse and/or longitudinal walls of a masonry unit, it is possible to operatively connect four masonry units together in a variety of juxtapositions, for example, multiple courses of end-to-end, side-by-side, or end-to-side masonry units.

Figure 3:
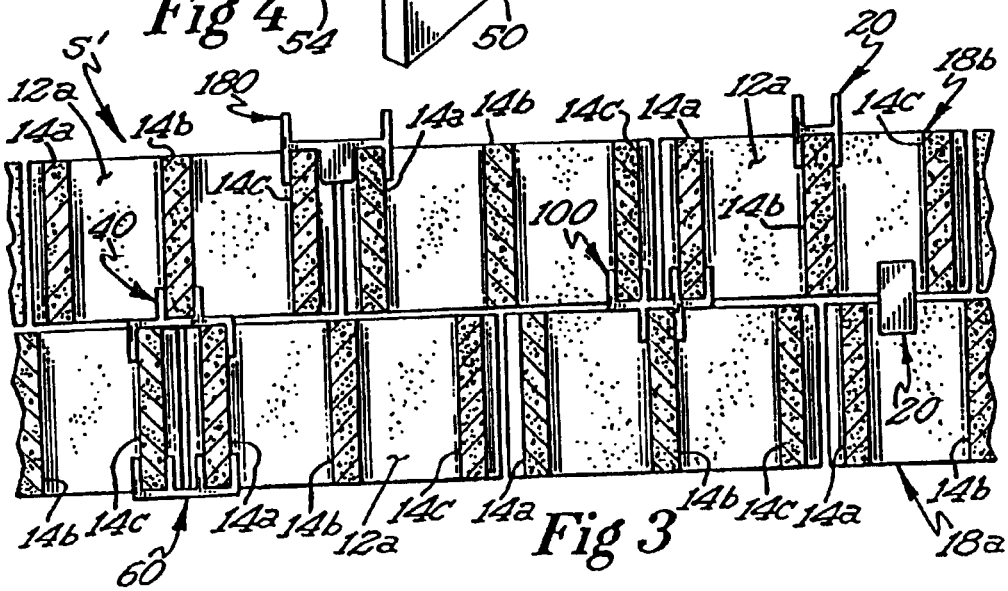
FIG. 3 is a perspective view of a preferred embodiment of the invention.

Referring now to FIG. 3, a structure S' comprising courses 18*a*, and 18*b* connected by some of the preferred embodiments of the fastening elements of the present invention is depicted. Note that the masonry units 10 of this structure S' are operatively connected to each other by fastening elements in either a direct or indirect fashion. Starting with the first, or bottom course 18*a*, a fastening element 60 having a plurality of projections that extend from one surface of a web is used to operatively connect two masonry units together in an end-to-end relation. With this fastening element 60 there are three slots, and the two outermost slots engage the lowermost edges of transverse walls 14*c* and 14*a* of adjacent masonry units. Moving up from the fastening element 60, another fastening element 40, having two differently sized opposing slots, is used to operatively connect the masonry units together. The larger of the slots operatively connects two masonry units together in an end-to-end fashion, while the smaller of the slots operatively engages a transverse wall 14*b* of masonry unit positioned thereabove. Next, a fastening element 180 is used to operatively connect two adjacent masonry units together in an end-to-end fashion. Then, a fastening element 100 is used to operatively connect two masonry units together in an end-to-end fashion. In addition, this fastening element 100 operatively engages a tranverse wall 14*b* of a masonry unit positioned therebelow. Finally, a fastening element 20 operatively connects adjacent masonry units together by engaging them at their respective longitudinal walls 12*a*. As will be appreciated, the number, location and style of the particular fastening element used may vary from application to application.

Referring now to FIGS. 4–9, some of the preferred embodiments of the invention will be briefly discussed. Starting with FIG. 4, the fastening element 40 comprises a generally planar web 42 having opposed surfaces 43*a*, 43*b*. A plurality of projections, 44 and 46, 48 and 50 extend from the opposed surfaces 43*a* and 43*b*, respectively. These projections extend in a generally perpendicular direction to define oppositely opening slots 52 and 54, which are configured and arranged to receive segments of a masonry unit such as a cinderblock. As depicted, the slots 52, 54 have different widths and are collaterally aligned with each other. They are also symmetrically arranged with respect to the web 42. It will be appreciated that by fabricating a fastening element having different slot widths, it is possible to operatively connect three masonry units together (see also, FIGS. 1 and 3).

Figure 5:
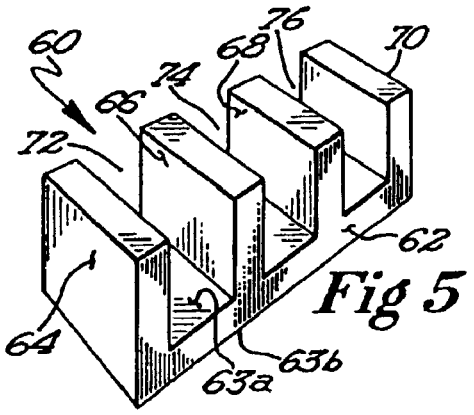
FIG. 5 is a perspective view of another preferred embodiment of the invention.

Referring now to the embodiment of FIG. 5, the fastening element 60 includes a web 62 with opposing surfaces 63*a*, 63*b* and a plurality of projections 64, 66, 68, and 70 that extend from one of the opposing surfaces of the web 62 in a generally perpendicular direction. In this embodiment, the projections 64, 66, 68, and 70 form at least two, and preferably three collaterally aligned slots 72, 74, and 76. As with the slots in the above embodiment, these slots 72, 74, 76 are configured to receive segments of masonry units such as the transverse walls to enable adjacent masonry units to be operatively connected to each other in an end-to-end relation (see, FIGS. 1 and 3). The fastening element 60 may receive segments of masonry units such as longitudinal walls to enable adjacent masonry units to be operatively connected to each other in side-by-side, and end-to side relations (not shown). While this preferred embodiment may be used between courses of masonry units, the preferred use is that of a bed or cap for lower and upper courses of masonry units, respectively.

Figure 6:
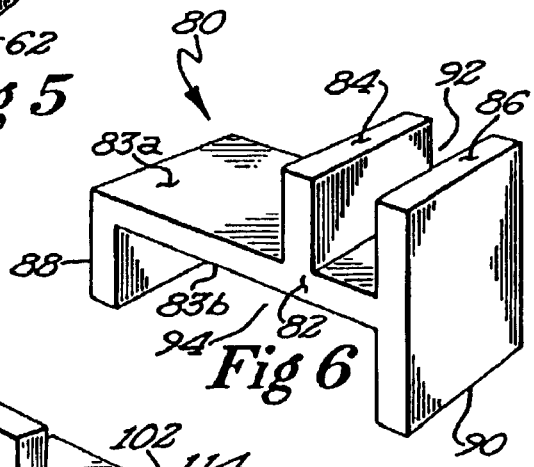
FIG. 6 is a perspective view of another preferred embodiment of the invention.

Referring now to FIG. 6, the fastening element 80 comprises a generally planar web 82 having opposed surfaces 83*a*, 83*b*. A plurality of projections, 84 and 86, 88 and 90 extend in a generally perpendicular direction from the opposed web surfaces 83*a* and 83*b*, respectively. These projections extend in a generally perpendicular direction with respect to the web 82, to define oppositely opening slots 92 and 94, which are configured and arranged to receive segments of a masonry unit as described above As depicted, the slots 92, 94 have different widths and are asymmetrically aligned with respect to each other. With this embodiment, it is possible to operatively connect multiple courses of three masonry units together in end-to-end, and side-to-end relations (see, for example, FIG. 1).

Figure 7:
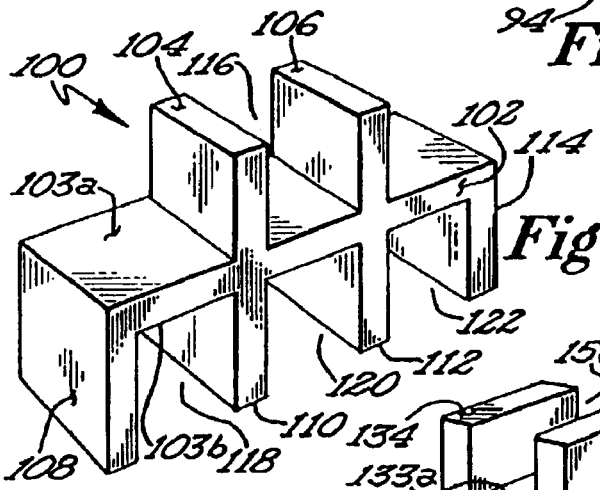
FIG. 7 is a perspective view of another preferred embodiment of the invention.

Referring now to FIG. 7, the fastening element 100 comprises a generally planar web 102 having opposed surfaces 103*a*, 103*b*. Here, a plurality of projections, 104 and 106 extend in a generally perpendicular direction from web surface 103*a* and define a slot 116, while a plurality of projections 108, 110, 112, and 114 extend in a generally perpendicular direction from web surface 103*b* and define slots 118, 120, and 122, respectively. The oppositely opening slots 116, and 118, 120, 122 are configured and arranged to receive segments of a masonry unit as described above As depicted, the slots are symmetrically aligned with respect to each other. With the fastening element of this embodiment, it is possible to operatively connect multiple courses of three masonry units together in end-to-end, and side-to-end relations (see, for example, FIG. 3).

Figure 8:
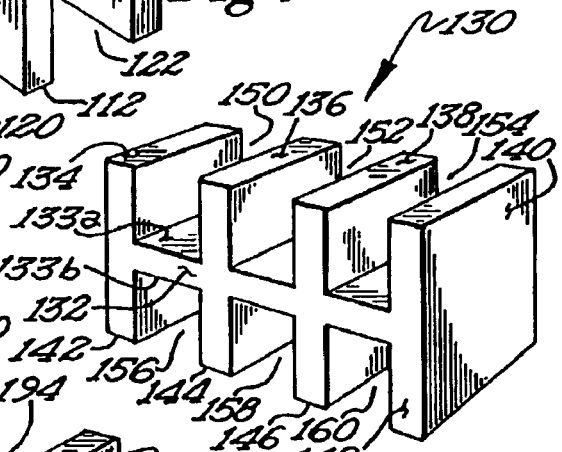
FIG. 8 is a perspective view of another preferred embodiment of the invention; and, FIG. 9 is a perspective view of another preferred embodiment of the invention.

Referring now to FIG. 8, the fastening element 130 comprises a generally planar web 132 having opposed surfaces 133*a*, 133*b*. Here, a plurality of projections, 134, 136, 138 and 140 extend in a generally perpendicular direction from web surface 133*a* and define slots 150, 152, 154, while a plurality of projections 142, 144, 146, and 148 extend in a generally perpendicular direction from web surface 133*b* and define slots 156, 158, and 160, respectively. The oppositely opening slots 150, 152, 154, and 156, 158, 160 are configured and arranged to receive segments of a masonry unit as described above. As depicted, the slots are symmetrically aligned with respect to each other. With the fastening element of this embodiment, it is possible to operatively connect multiple courses of two, three, or four masonry units together in end-to-end, side-by side, and side-to-end relations.

Figure 9:
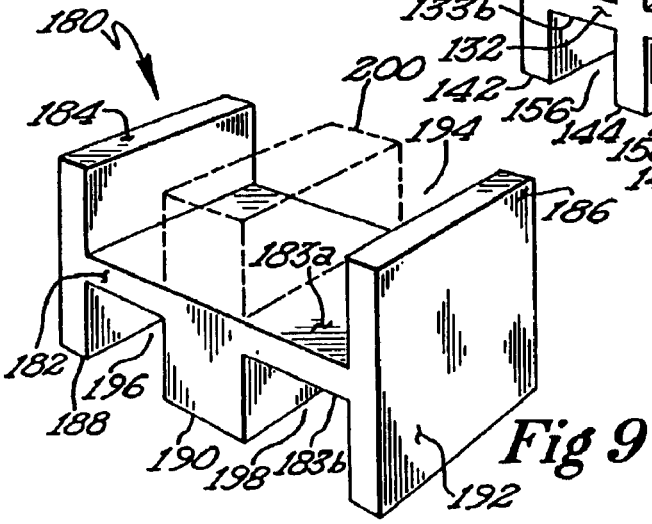

Referring now to FIG. 9, the fastening element 180 comprises a generally planar web 182 having opposed surfaces 183*a*, 183*b*. Here, a plurality of projections, 184 and 186 extend in a generally perpendicular direction from web surface 183*a* and define a slot 194, while a plurality of projections 188, 190, and 192 extend in a generally perpendicular direction from web surface 183*b* and define slots 196, and 198, respectively. The oppositely opening slots 194, and 196, 198 are configured and arranged to receive segments of a masonry unit as described above. As depicted, the slots are aligned with respect to each other. With the fastening element of this embodiment, it is possible to operatively connect multiple courses of two or more masonry units together in various relations (see, for example, FIG. 3). It is also envisioned that the fastening element 180 be provided with an additional projection 200 (shown in dashed lines) to form two slots from the single slot 194.

The present invention having thus been described, other modifications, alterations or substitutions may present themselves to those skilled in the art, all of which are within the spirit and scope of the present invention. It is therefore intended that the present invention be limited in scope only by the claims attached below:

What is claimed is:

1. The combination of at least two masonry blocks of the type having a plurality of spaced-apart vertical wall segments, and a fastening element, the fastening element comprising:

a body having:

a generally planar web having opposing surfaces; and, a plurality of projections, with the projections extending from the web in a generally perpendicular direction relative to the web, with the projections defining a first slot and a second slot, and with the first and second slots configured to receive vertical wall segments of adjacent masonry blocks;

whereby adjacent masonry blocks can be operatively connected to each other in a multiple course structure.

2. The combination of claim 1, wherein the first and second slots of the fastening element are in substantial alignment with respect to each other.

3. The combination of claim 1, wherein the first and second slots of the fastening element are in substantial collateral alignment with respect to each other.

4. The combination of claim 1, wherein the projections of the fastening element that define the first slot extend in a first direction and the projections of the fastening element that define the second slot extend in a second, different direction.

5. The combination claim 1, wherein the first slot of the fastening element has a predetermined width and the second slot of the fastening element has a different, predetermined width.

6. The combination of claim 1, wherein the projections of the fastening element are configured to operatively connect at least three masonry units together in a multiple course structure.

7. A fastening element for operatively connecting at least two masonry units together in a multiple course structure, the fastening element comprising:

a body having a generally planar web with opposing surfaces;

a first plurality of projections extending in a generally perpendicular direction from one of the web surfaces, with the first plurality of projections defining at least two slots, wherein each slot configured to receive segments of first and second masonry units, respectively, and thereby operatively connect the first and second masonry units together in a first course of blocks; and, a second plurality of projections extending in a generally perpendicular direction from the other opposing surface of the web, with the second plurality of projections defining at least two slots, wherein each slot is configured to receive segments of third and fourth masonry units that are positioned in a vertically adjacent course of blocks;

whereby the first, second, third, and fourth masonry units are operatively connected to each other in a multiple course structure.

* * * * *